US009226576B2

(12) United States Patent
Shang et al.

(10) Patent No.: US 9,226,576 B2
(45) Date of Patent: Jan. 5, 2016

(54) ADJUSTABLE STRUCTURE OF COMBINATION CABINET

(71) Applicants: Kuo Wen Shang, Taichung (TW); Benson Chen, Taichung (TW)

(72) Inventors: Kuo Wen Shang, Taichung (TW); Benson Chen, Taichung (TW)

( * ) Notice: Subject to any disclaimer, the term of this patent is extended or adjusted under 35 U.S.C. 154(b) by 0 days.

(21) Appl. No.: 14/483,777

(22) Filed: Sep. 11, 2014

(65) Prior Publication Data

US 2015/0069894 A1 Mar. 12, 2015

(30) Foreign Application Priority Data

Sep. 12, 2013 (TW) ..... 102217144 U

(51) Int. Cl.
*A47B 47/00* (2006.01)

(52) U.S. Cl.
CPC ..... *A47B 47/0075* (2013.01); *A47B 47/0033* (2013.01)

(58) Field of Classification Search
CPC ..... A47B 47/00; A47B 47/0008; A47B 47/0016; A47B 47/0025; A47B 47/0033; A47B 47/0075; A47B 47/0091
USPC ..... 312/257.1, 107, 108, 111, 140, 348.3, 312/351
See application file for complete search history.

(56) References Cited

U.S. PATENT DOCUMENTS

| | | | | | |
|---|---|---|---|---|---|
| 3,913,289 | A * | 10/1975 | Recker | ..... | 312/140 |
| 4,258,856 | A * | 3/1981 | Marling | ..... | 220/552 |
| 4,493,425 | A * | 1/1985 | Yoshida | ..... | 211/189 |
| 5,470,139 | A * | 11/1995 | Hsiao | ..... | 312/140 |
| 5,715,956 | A * | 2/1998 | Yoshida | ..... | 211/182 |
| 5,720,547 | A * | 2/1998 | Baird | ..... | 312/107 |
| 6,267,462 | B1 * | 7/2001 | Krause et al. | ..... | 312/111 |
| 6,332,657 | B1 * | 12/2001 | Fischer | ..... | 312/111 |
| 2009/0309464 | A1 * | 12/2009 | Schwartz | ..... | 312/111 |

* cited by examiner

*Primary Examiner* — James O Hansen
(74) *Attorney, Agent, or Firm* — Wang Law Firm, Inc.; Li K. Wang; Stephen Hsu

(57) ABSTRACT

An adjustable structure of combination cabinet includes a plurality of assembling plates assembled as a whole cabinet via a plurality of assembling members, the whole cabinet having a side opening and a receiving space, a first partition plate assembled in the receiving space, the first partition plate vertically assembled between two assembling plates, a plurality of adjusting members slidably mounted on the two assembling plates, the first partition plate moved in the receiving space via moving the adjusting members, each adjusting member having a sliding groove extended horizontally and a socket extended vertically, each adjusting member mounted on the two assembling plates via the sliding groove thereof, the first partition plate assembled to the socket, the adjusting members slid along the assembling plate via the sliding groove, the first partition plate movable in the receiving space so as to adjust the arrangement between the two sub spaces.

5 Claims, 6 Drawing Sheets

ADJUSTABLE STRUCTURE OF COMBINATION CABINET

CROSS-REFERENCE TO RELATED APPLICATION

The present invention claims the benefit of priority to TW 102217144, filed on Sep. 12, 2013 with the Intellectual Property Office of the Republic of China, Taiwan, the specification of which is hereby incorporated in its entirety by reference.

BACKGROUND OF THE INVENTION

1. Field of the Invention

The present invention relates to an adjustable structure, and more particularly to an adjustable structure of combination cabinet.

2. Description of the Prior Art

A conventional combination cabinet comprises a plurality of assembling plates assembled as a whole cabinet. Because the assembling method is very convenient, the conventional combination cabinet is very popular. However, after assembling, the receiving space therein is unadjustable. Therefore, it would be very inconvenient for the user.

The present invention is, therefore, arisen to obviate or at least mitigate the above mentioned disadvantages.

SUMMARY OF THE INVENTION

An object of the present invention is to provide an improved adjustable structure of combination cabinet, in which the sub spaces therein is adjustable.

To achieve the above and other objects, an adjustable structure of combination cabinet comprises a plurality of assembling plates assembled as a whole cabinet via a plurality of assembling members, the whole cabinet having a side opening, the whole cabinet having a receiving space formed therein, a first partition plate assembled in the receiving space, so as to partition the receiving space into two sub spaces, the first partition plate vertically assembled between two assembling plates which are horizontally opposite to each other, a plurality of adjusting members slidably mounted on the two assembling plates, the first partition plate moved in the receiving space via moving the adjusting members, so as to adjust the arrangement between the two sub spaces, each adjusting member having a sliding groove extended horizontally and a socket extended vertically, so that the sliding groove and the socket are arranged as T shape, each adjusting member mounted on the two assembling plates via the sliding groove thereof, the first partition plate assembled to the socket, so that the first partition plate assembled between two assembling plates, the adjusting members slid along the side of the assembling plate via the sliding groove thereof, the first partition plate movable in the receiving space so as to adjust the arrangement between the two sub spaces.

Wherein the sliding groove of each adjusting member has two side walls; one side wall has an extending portion extending therefrom; the extending portion has at least one bore formed thereon; the assembling plate has a plurality of positioning holes formed along a side thereof; each adjusting member moves the first partition plate to a position, in which the bore faces one positioning hole and a positioning member passes therethrough so as to fix the first partition plate.

Wherein the first partition plate has a elongated through hole extended toward the side opening of the whole cabinet; a second partition plate passes through the elongated through hole so that the first partition plate and the second partition plate are arranged as cross shape; the second partition plate is assembled between the assembling plates, via the adjusting members.

Wherein the sliding groove of each adjusting member has two side walls; one side wall has an extending portion extending therefrom; the extending portion has at least one bore formed thereon; the assembling plate has a plurality of positioning holes formed along a side thereof; the adjusting members is fixed on the assembling plate via the positioning member, so as to position the second partition plate in the receiving space; the first partition plate is slid along the second partition plate via the elongated through hole, so as to adjust the arrangement between the four sub spaces of the receiving space.

Wherein the positioning member has a plunger; a tip of the plunger is split into two elastic flanges opposite to each other; a recovery force makes the two elastic flanges spaced from each other; the plunger passes through the bore of one adjusting member and one positioning hole of the assembling plate, the two elastic flanges abut against the bore and the positioning hole; a buckle buckles the two elastic flanges so as to fix the adjusting member on the assembling plate.

Wherein each assembling member has four recesses outwardly extended from a central point, so as to be arranged as cross shape.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
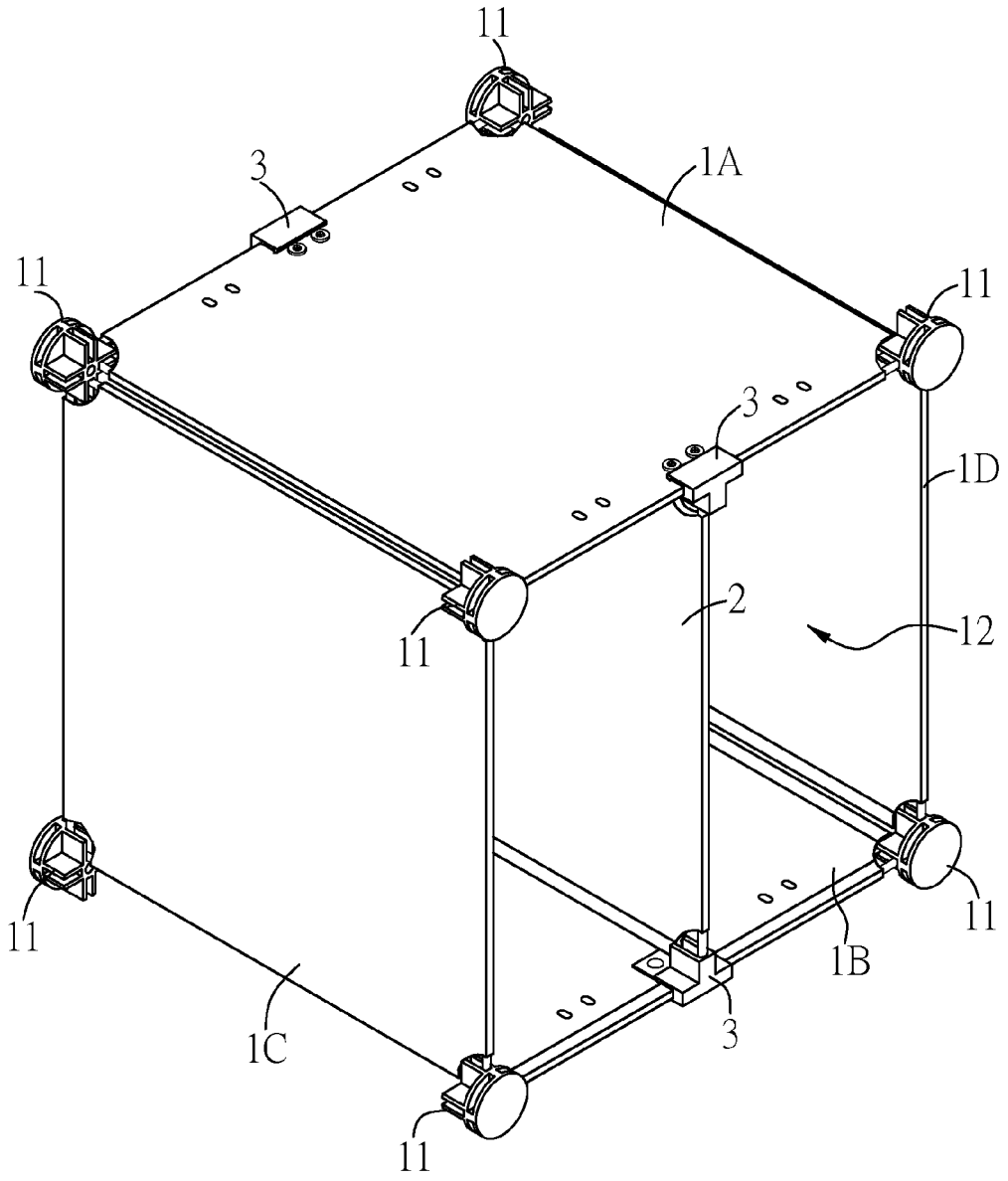
FIG. 1 is a perspective view of a first embodiment of the present invention.
Figure 2:
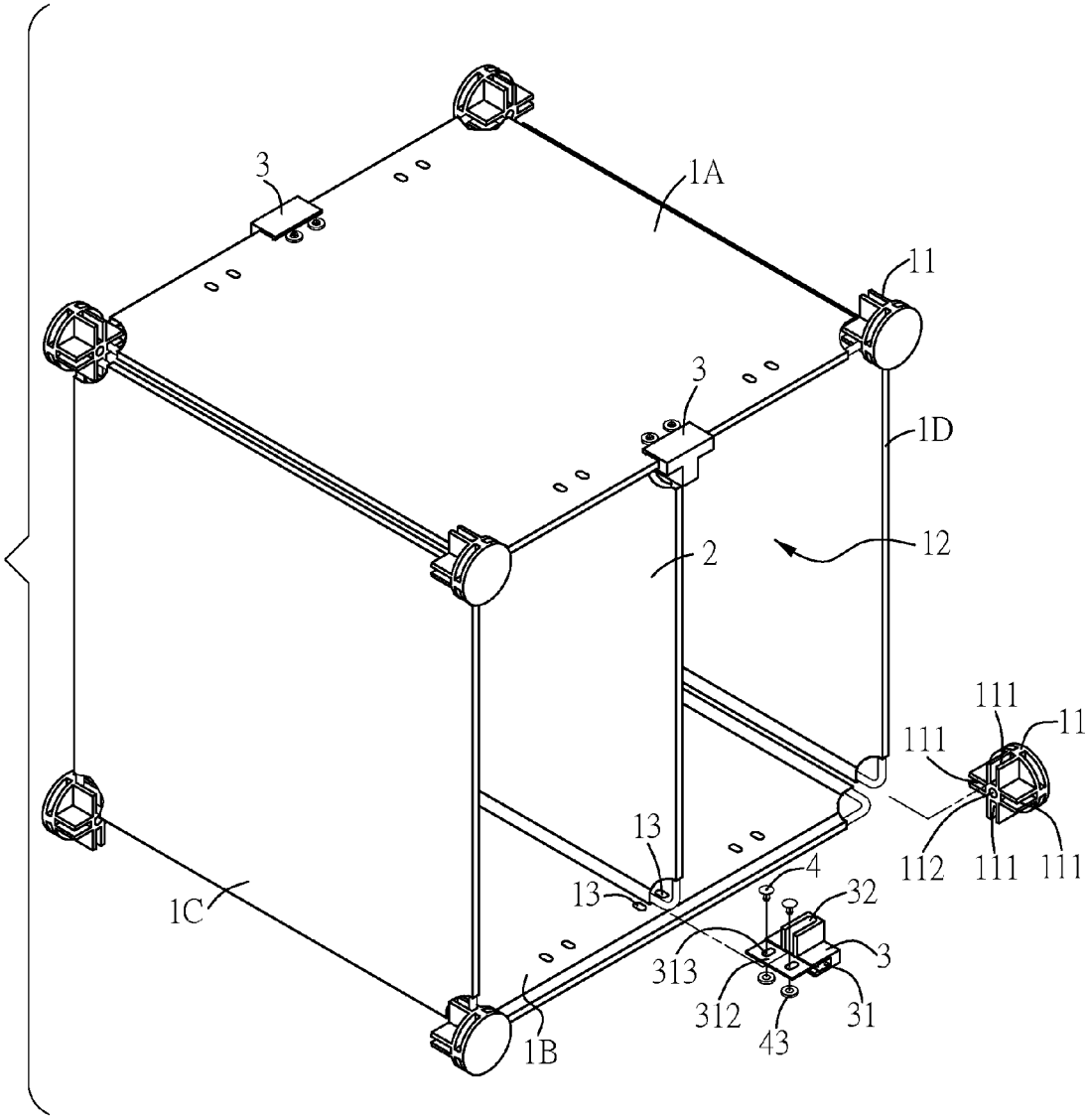
FIG. 2 is an explored view of the first embodiment.
Figure 3:
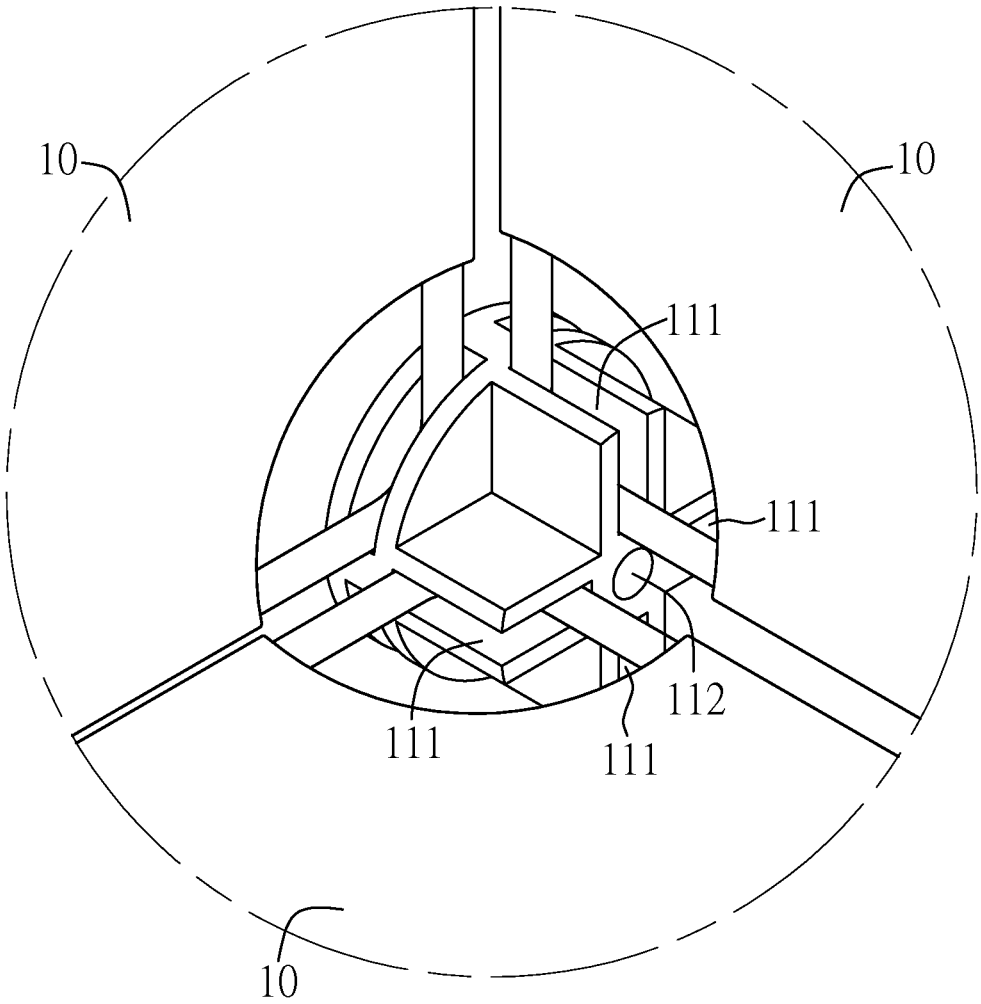
FIG. 3 is an enlarged view of the first embodiment for showing a relationship between an assembling plate and an assembling member.

Referring to FIGS. 1-2, a first embodiment in accordance with an adjustable structure of combination cabinet of the present invention is described as follows. The adjustable structure of combination cabinet comprises a plurality of assembling plates 10 and a plurality of assembling members 11. The assembling plates 10 are assembled as a whole cabinet, via the assembling members 11. The whole cabinet has a side opening Referring to FIG. 3, each assembling member 11 has four recesses 111. The four recesses 111 are outwardly extended from a central point 112, so as to be arranged as cross shape. Each assembling plate 10 could be inserted into each corresponding recess 111, according to arrangement, so as to be assembled as the whole cabinet. The whole cabinet has a receiving space 12 formed therein. A first partition plate 2 is assembled in the receiving space 12, so as to partition the receiving space 12 into two sub spaces. Clearly, the first partition plate 2 is vertically assembled between two assembling plates 1A and 1B which are horizontally opposite to each other. A plurality of adjusting members 3 is slidably mounted on the two assembling plates 1A and 1B. Specially, moving the adjusting members 3, the first partition plate 2 is moved in the receiving space 12 so as to adjust the arrangement between the two sub spaces.

Figure 4:
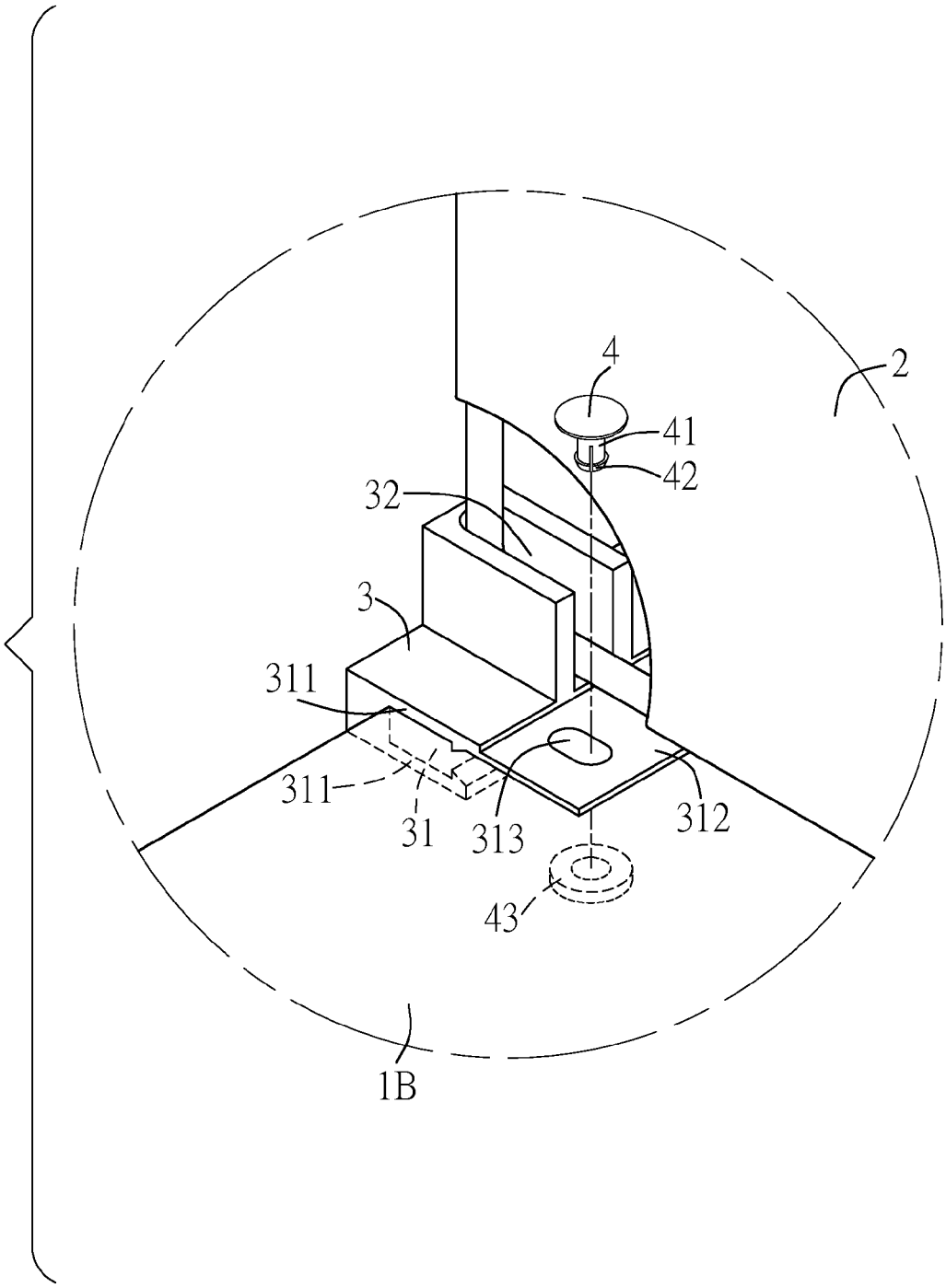
FIG. 4 is an enlarged view of the first embodiment for showing the assembling plate and a partition plate.

Referring to FIGS. 2 and 4, each adjusting member 3 has a sliding groove 31 extended horizontally and a socket 32 extended vertically, so that the sliding groove 31 and the socket 32 are arranged as T shape. Each adjusting member 3 is mounted on the two assembling plates 1A and 1B via the sliding groove 31 thereof. The first partition plate 2 is assembled to the socket 32, so that the first partition plate 2 is assembled between two assembling plates 1A and 1B. Specially, the adjusting members 3 could be slid along the side of the assembling plate 1A or 1B via the sliding groove 31 thereof. Therefore, the first partition plate 2 is movable in the receiving space 12 so as to adjust the arrangement between the two sub spaces. Thereafter, each adjusting member 3 is positioned on the assembling plate 1A or 1B via a positioning member 4, so as to fix the first partition plate 2 in the receiving space 12. Clearly, referring to FIGS. 2 and 4, the sliding groove 31 of each adjusting member 3 has two side walls 311. One side wall 311 has an extending portion 312 extending therefrom. The extending portion 312 has at least one bore 313 formed thereon. The assembling plate 1A or 1B has a plurality of positioning holes 13 formed along a side thereof Each adjusting member 3 could move the first partition plate 2 to a position, in which the bore 313 faces one positioning hole 13 and a positioning member 4 passes therethrough so as to fix the first partition plate 2. Clearly, the positioning member 4 has a plunger 41. A tip of the plunger 41 is split into two elastic flanges 42 opposite to each other. A recovery force makes the two elastic flanges 42 spaced from each other. When the plunger 41 of the positioning member 4 passes through the bore 313 of one adjusting member 3 and one positioning hole 13 of the assembling plate 1A or 1B, the two elastic flanges 42 abut against the bore 313 and the positioning hole 13. Thereafter, a buckle 43 buckles the two elastic flanges 42 so as to fix the adjusting member 3 on the assembling plate 1A or 1B.

Under this arrangement, the adjusting members could be slid along the side of the assembling plate. Therefore, the first partition plate is movable in the receiving space so as to adjust the arrangement between the two sub spaces.

Figure 5:
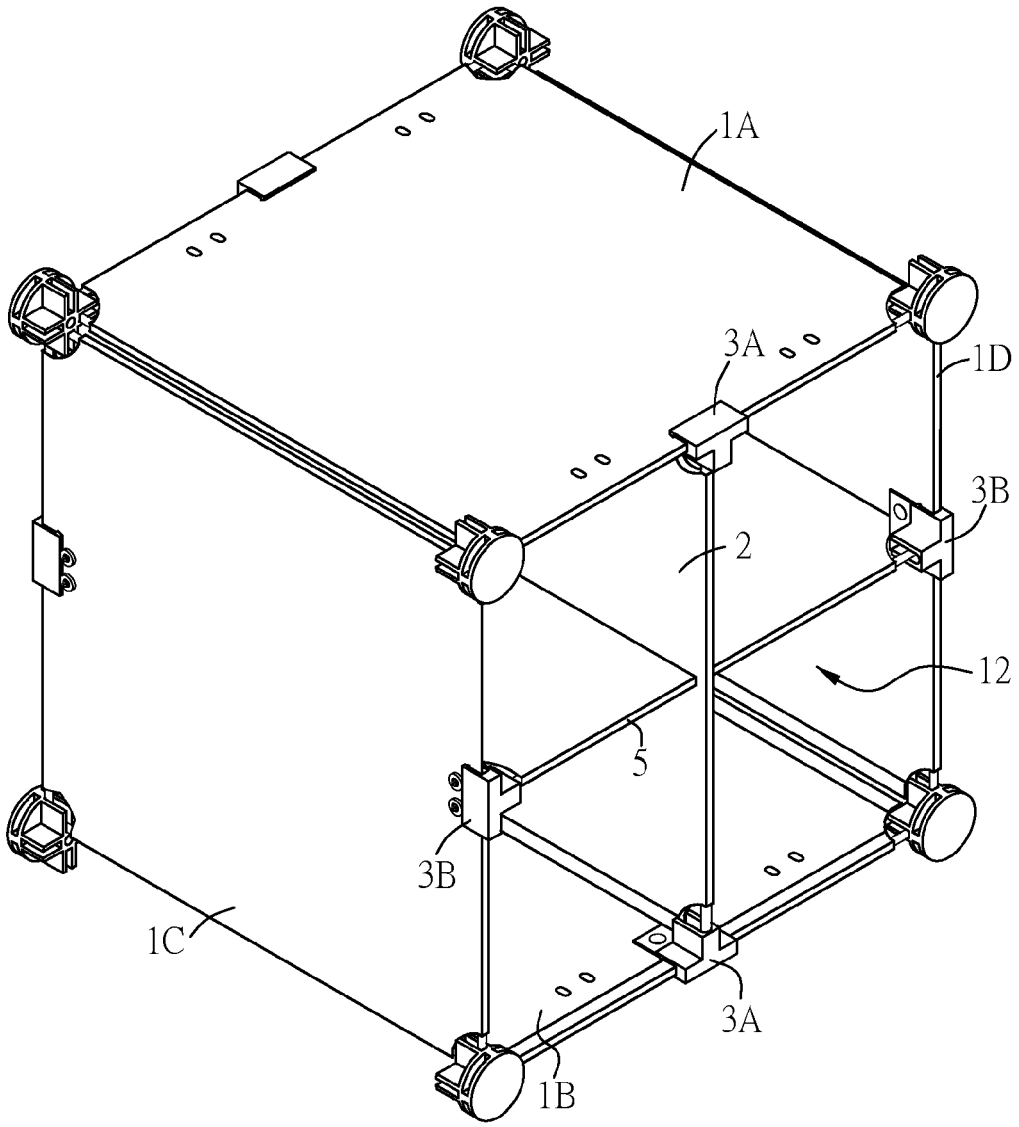
FIG. 5 is a perspective view of a second embodiment of the present invention.
Figure 6:
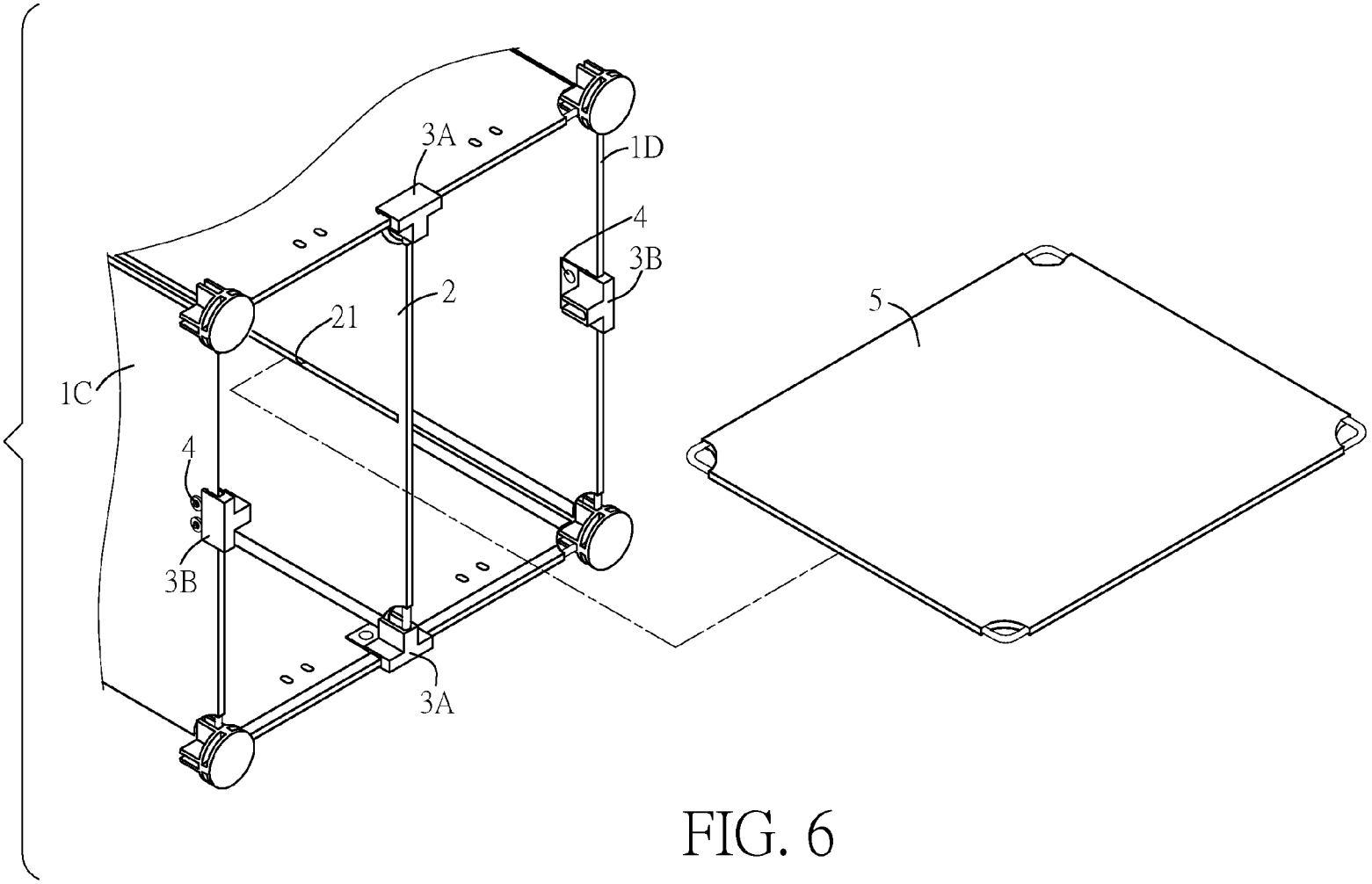
FIG. 6 is an explored view of the second embodiment.

Referring to FIGS. 5-6, a second embodiment of the present invention is described as follows (only the difference between the first and second embodiments would be described herein.). The first partition plate 2 has a elongated through hole 21 extended toward the side opening of the whole cabinet. A second partition plate 5 passes through the elongated through hole 21 so that the first partition plate 2 and the second partition plate 5 are arranged as cross shape. The second partition plate 5 is assembled between the assembling plates 1C and 1D, via the adjusting members 3B. Therefore, the receiving space 12 is partitioned into four sub spaces. The adjusting members 3B is fixed on the assembling plate 1C or 1D via the positioning member 4, so as to position the second partition plate 5 in the receiving space 12. When the first partition plate 2 is moved, the first partition plate 2 is slid along the second partition plate 5 via the elongated through hole 21, so as to adjust the arrangement between the four sub spaces of the receiving space 12.

Although particular embodiments of the invention have been described in detail for purposes of illustration, various modifications and enhancements may be made without departing from the spirit and scope of the invention. Accordingly, the invention is not to be limited except as by the appended claims.

The invention claimed is:

1. An adjustable structure of combination cabinet comprising:

a plurality of assembling plates assembled as a whole cabinet via a plurality of assembling members, the whole cabinet having a side opening, the whole cabinet having a receiving space formed therein, a first partition plate assembled in the receiving space, so as to partition the receiving space into two sub spaces, wherein the first partition plate assembled perpendicularly to two opposite assembling plates both through a plurality of adjusting members, and the adjusting members slidably mounted on the two assembling plates, the first partition plate moved in the receiving space via moving the adjusting members, so as to adjust the arrangement between the two sub spaces, each adjusting member having a sliding groove extended horizontally and a socket extended vertically, so that the sliding groove and the socket are arranged as T shape, each adjusting member mounted on the two assembling plates via the sliding groove thereof, the first partition plate assembled to the socket, so that the first partition plate assembled between two assembling plates, the adjusting members slid along the side of the assembling plate via the sliding groove thereof, the first partition plate movable in the receiving space so as to adjust the arrangement between the two sub spaces;

wherein the sliding groove of each adjusting member has two side walls; one side wall has an extending portion extending therefrom; the extending portion has at least one bore formed thereon; the assembling plate has a plurality of positioning holes formed along a side thereof; each adjusting member moves the first partition plate to a position, in which the bore faces one positioning hole and a positioning member passes therethrough so as to fix the first partition plate.

2. The adjustable structure of combination cabinet as claimed in claim 1, wherein the first partition plate has a elongated through hole extended toward the side opening of the whole cabinet; a second partition plate passes through the elongated through hole so that the first partition plate and the second partition plate are arranged as cross shape; the second partition plate is assembled between the assembling plates, via the adjusting members.

3. The adjustable structure of combination cabinet as claimed in claim 2, wherein the sliding groove of each adjusting member has two side walls; one side wall has an extending portion extending therefrom; the extending portion has at least one bore formed thereon; the assembling plate has a plurality of positioning holes formed along a side thereof; the adjusting members is fixed on the assembling plate via the positioning member, so as to position the second partition plate in the receiving space; the first partition plate is slid along the second partition plate via the elongated through hole, so as to adjust the arrangement between the four sub spaces of the receiving space.

4. The adjustable structure of combination cabinet as claimed in claim 1, wherein the positioning member has a plunger; a tip of the plunger is split into two elastic flanges opposite to each other; a recovery force makes the two elastic flanges spaced from each other; the plunger passes through the bore of one adjusting member and one positioning hole of the assembling plate, the two elastic flanges abut against the bore and the positioning hole; a buckle buckles the two elastic flanges so as to fix the adjusting member on the assembling plate.

5. The adjustable structure of combination cabinet as claimed in claim 1, wherein each assembling member has four recesses outwardly extended from a central point, so as to be arranged as cross shape.

* * * * *